US006397498B1

(12) United States Patent
Yoo

(10) Patent No.: US 6,397,498 B1
(45) Date of Patent: Jun. 4, 2002

(54) SPORTS SHOES FOR TRAINING PHYSICAL STRENGTH

(76) Inventor: YongDon Yoo, 18/5, 592-20, MangMi-1dong, SuYoung-Ku, Pusan, 604-022 (KR)

( * ) Notice: Subject to any disclaimer, the term of this patent is extended or adjusted under 35 U.S.C. 154(b) by 0 days.

(21) Appl. No.: 09/656,589

(22) Filed: Sep. 7, 2000

(30) Foreign Application Priority Data

Nov. 26, 1999 (KR) ..... 99-26659

(51) Int. Cl.[7] ..... A43B 5/00; A43B 13/00; A43B 13/12

(52) U.S. Cl. ..... 36/132; 36/29; 36/35 B; 36/30 A; 36/103; 482/105

(58) Field of Search ..... 482/93, 105; 36/132, 36/136, 27, 29, 38, 35 B, 3 R, 3 B, 28, 30 R, 36 A, 44, 102, 103

(56) References Cited

U.S. PATENT DOCUMENTS

| | | | | | |
|---|---|---|---|---|---|
| 819,449 | A | * | 5/1906 | Otterstedt | 36/3 B |
| 3,785,646 | A | * | 1/1974 | Ruskin | 36/132 |
| 4,430,810 | A | * | 2/1984 | Bente | 36/136 |
| 4,598,487 | A | * | 7/1986 | Misevich | 36/136 |
| 4,864,738 | A | * | 9/1989 | Horovitz | 36/29 |
| 5,189,814 | A | * | 3/1993 | Barma | 36/55 |
| 5,231,776 | A | * | 8/1993 | Wagner | 36/132 |
| 5,343,637 | A | * | 9/1994 | Schindler | 36/28 |
| 5,505,010 | A | * | 4/1996 | Fukuoka | 36/3 R |
| 5,651,196 | A | * | 7/1997 | Hsieh | 36/27 |
| 5,671,552 | A | * | 9/1997 | Pettibone et al. | 36/27 |
| 6,170,173 | B1 | * | 1/2001 | Caston | 36/3 B |

* cited by examiner

*Primary Examiner*—Anthony Stashick
(74) *Attorney, Agent, or Firm*—Notaro & Michalos P.C.

(57) ABSTRACT

Sports shoes for training physical strength which are divided into the uppers, middle layer of a shoe sole, and the bottom sole, including: a rubber seat inserted at both sides and the back of the uppers; a high-elastic sponge adhered at bottom surface of the middle layer thereof; and, a plurality of holes widely distributed at the upper surface of the bottom sole, springs engaged in each hole, a first space and a second space shaped to the fore and the back of the bottom sole, metal tubes engaged with given intervals in the first and second spaces, and polyurethane charged between the metal tubes.

1 Claim, 2 Drawing Sheets

SPORTS SHOES FOR TRAINING PHYSICAL STRENGTH

BACKGROUND OF THE INVENTION

1. Field of the Invention

The present invention relates to sports shoes, and more particularly, to sports shoes for training physical strength with heavy weight by inserting heavy material into the sole of the sports shoes, thereby training for physical strength.

2. Description of the Related Art

Conventionally, people, in general, or athletes specifically reinforce muscles of the lower port of the body while training their strength by tying gaiters nor sandbag at the calf of the leg,. for the sake of training for physical strength. However, inconvenience occurs in putting the gaiters or the sandbag on and off in usage.

In order to solve the above problem, shoe weight is increased by inserting heavy material (such as iron beads and metal plates) into the inner of the out sole of shoes. A small problem is caused, however, in manufacturing or using this type of shoe. Namely, the shoes manufactured with iron beads mixed with the bond at the inner of the out sole thereof generates unbalance in the weight because of not inserting the iron beads with given intervals thereinto as well as needing many manufacturing steps for molding. Also, the shoes for training physical strength by inserting metal plate into the inner of the out sole thereof as disclosed in Korea Laid-Open Utility Model No. 98-55768 have small elasticity and generate inconvenience in action of the feet. Damage, such as fracture of the toes and the ankle or accumulating fatigue at the feet can also occur.

BRIEF DESCRIPTION OF THE DRAWINGS

A more complete appreciation of this invention, many of the attendant advantages thereof, will be readily apparent as the same becomes better understood by reference to the following detailed description when considered in conjunction with the accompanying drawings, in which like reference symbols indicate the same or similar elements and wherein.

SUMMARY OF THE INVENTION

It is therefore an object of the present invention for solving the above problem to provide shoes for training physical strength by inserting weight into the inner of the bottom sole of the shoes so as to heighten elasticity and increase flexibility, thereby not causing damage at the feet.

It is another object of the present invention to provide shoes for training physical strength with inserting rubber material into the inner of the uppers of the leather shoes, thereby reinforcing the elasticity.

These and other objects can be achieved according to the present invention with sports shoes for training physical strength which are divided into the uppers, middle layer of a shoe sole, and the bottom sole, including: a rubber seat inserted at both sides and the back of the uppers; a high-elastic sponge adhered at bottom surface of the middle layer thereof; and, a plurality of holes widely distributed at the upper surface of the bottom sole, a spring engaged to the bottom sole, a first space and a second space shaped to the fore and the back of the bottom sole, metal tubes engaged with given intervals between the first and second spaces, and polyurethane charged between the metal tubes.

DETAILED DESCRIPTION OF THE PREFERRED EMBODIMENTS

Hereinafter, a preferred embodiment of the present invention will be in detail explained with reference to the accompanying drawings. Further, in the following description, the necessary description for understanding the present invention are set forth to provide a more thorough understanding of the present invention. It is noted that a detailed description of known functions and constructions unnecessarily obscuring the subject matter of the present invention has been omitted in the following description for clarity.

Figure 1:
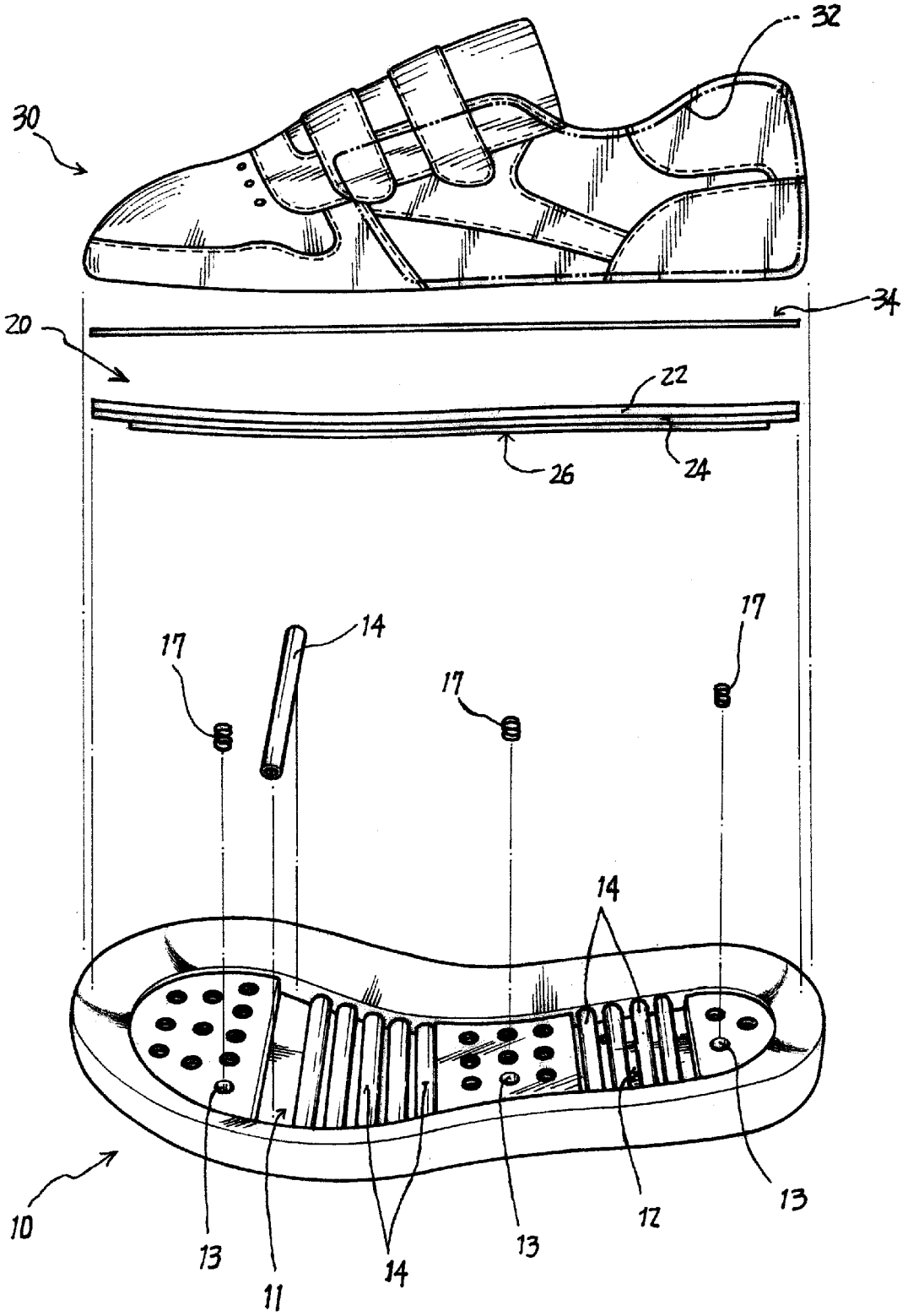
FIG. 1 is an exploded side view showing a shoe for training physical strength according to an embodiment of the present invention.
Figure 2:
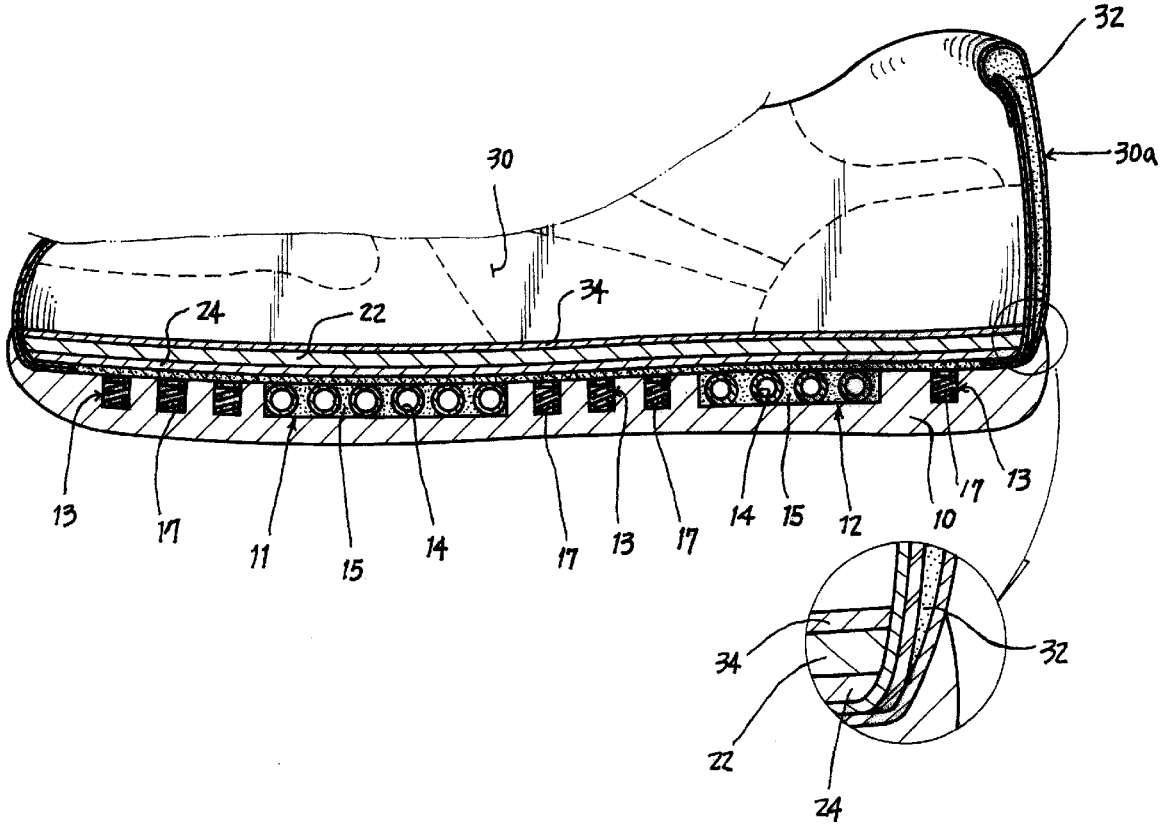
FIG. 2 is a center sectional view showing a shoe for training physical strength according to an embodiment of the present invention.

FIG. 1 is a separated side view showing shoes for training physical strength with inserting the weight material and elastic material into the bottom sole according to an embodiment of the present invention, wherein the shoes for training physical strength are divided into the uppers, the middle layers of a shoe sole, and the bottom soles. Also, FIG. 2 is a center sectional view showing shoes for training physical strength according to an embodiment of the present invention, wherein a rubber seat 32 is inserted into the inner of the uppers of the shoes, a sponge is adhered to the bottom surface of the middle layer of the shoe sole, elastic materials and weight materials are inserted into the inner of the upper surface of the bottom sole 10.

More particularly, the uppers 30 of the shoes have a space connected to both side surfaces of back axis 30*a* and a rubber seat 32 is engaged to the space. Also, an inner sole 34 and a middle layer of the shoe-sole 20 are adhered in order at the bottom surface of the uppers 30, and a high-elastic sponge 26 is adhered to the bottom surface of the middle layer of the shoe sole sticked with given elasticities 22 and 24 by the bond. The bottom sole 10 adhered at the lower portion of the middle layer of the shoe sole 20 has a plurality of vertical holes 13 with given intervals and shapes, a first space 11 and a second space 12, the spaces 11 and 12 having the given depth in the fore and the back. Herein, a coil spring 17 is engaged to each hole 13 and is protruded to the upper, and a metal tube 14 having weight material is horizontally formed with minute intervals. It is irrelevant to use a metal patch instead of the metal tube 14 and the weight can be adjusted to a necessary weight according to the size and the number of the tubes. As stated before, the empty space between the first space 11 and the second space 12 engaged to the metal tube 14 is filled with charging polyurethane 15. Holes 13 are in a front, central and rear area of the sole, spaced by the spaces 11 and 12.

Meanwhile, the bottom sole 10 engaged with the weight material and the spring is adhered to the middle layer of the shoe sole 20, and the metal tubes 14 as horizontally engaged are positioned to the fore and the back with the given intervals to thereby be bend easily. Therefore, it is preferable that the first space 11 of the fore engaged to the metal tube 14 is formed between the fore and the middle portion, namely, at portion having bending of the feet in walking. Also, the second space 12 of the back is shaped at the heel of the shoes having no bending and can be inserted with the metal plate instead of the metal tube 14.

The sponge 26 sticked at the bottom surface of the middle layer of the shoe sole 20 heightens the elasticity while supporting the upper portion of the spring 17 distributed at the bottom sole, and the rubber seat 32 engaged like protecting both sides and back portion of the uppers 30 is provided to safely protect the feet and to restore the sports shoe to original state. That is, upon having impact with the external in exercise, the rubber can mitigate the impact. Likewise, the rubber seat can always store the elasticity when the back axis 30*a* is crushed in putting on/off the shoes.

As may be apparent from the foregoing, the present invention can heighten the efficiency in the exercise with inserting the weight material into the inner of the shoes, wherein the above weight material can protect the bond fracture below the ankle in the exercise because being flexible and widely distributed springs 17 increase the cushion force thereby protecting the ankle from the impact at the ground. Further, the rubber seat engaged between the uppers can mitigate the impact from the external and prevent the water from being penetrated. Furthermore, it has advantage in that the shoes can be maintained to original shape with not being crushed.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. therefore, it is intended that the present invention not be limited to the particular embodiments disclosed as the best mode contemplated for carrying out the present invention, but that the present invention includes all embodiments falling within the scope of the appended claims.

What is claimed is:

1. A sports shoe for physical strength training, comprising:

an upper having opposite sides and a back;

a middle layer connected to the upper and having a bottom surface;

a bottom sole connected to the middle layer, the bottom sole having an upper surface, a front area, a central area and a rear area, a first space in the upper surface of the bottom sole between the front area and the central area, a second space in the upper surface of the bottom sole between the central area and the rear area, a plurality of vertical holes spaced from each other and extending into the upper surface in the front, central and rear areas of the bottom sole;

a rubber seat at both the opposite sides and at the back of the upper;

a high-elastic sponge adhered to the bottom-surface of the middle layer over the upper surface of the bottom sole;

a spring engaged into each vertical hole;

a plurality of spaced apart, transverse metal tube weights engaged in and space along each of the first and second spaces; and polyurethane filling the first and second spaces in the bottom sole between the metal tubes and under the high-elastic sponge.

* * * * *